United States Patent [19]

Michalec

[11] Patent Number: 4,750,744

[45] Date of Patent: Jun. 14, 1988

[54] GOLF PRACTICE APPARATUS

[76] Inventor: Ondrej Michalec, 37170 Robinhood, Apt. 81, Sterling Heights, Mich. 48077

[21] Appl. No.: 869,710

[22] Filed: Jun. 2, 1986

[51] Int. Cl.[4] ..... A63B 69/36

[52] U.S. Cl. ..... 273/181 A; 273/181 F

[58] Field of Search ..... 273/181 A, 181 F, 400, 273/394, 396, 398, 402, 181 D, 181 R, 182 R, 182 A

[56] References Cited

U.S. PATENT DOCUMENTS

| | | | |
|---|---|---|---|
| 1,927,741 | 9/1933 | Herbert | 273/32 |
| 2,232,569 | 2/1941 | Johnson | 273/35 |
| 2,455,185 | 11/1948 | May | 273/181 R |
| 3,142,488 | 7/1964 | Portteus | 273/201 |
| 3,594,006 | 7/1971 | Clatt | 273/176 R |
| 3,623,731 | 11/1971 | Forcher | 273/176 FA |
| 3,720,413 | 3/1973 | Ready | 273/182 R |
| 3,741,549 | 6/1973 | Wilson | 273/181 A |
| 3,810,616 | 5/1974 | Murphy | 273/181 A X |
| 3,889,957 | 6/1975 | Klabacka | 273/182 R |
| 3,942,798 | 3/1976 | Koski | 273/182 R |
| 3,986,719 | 10/1976 | Lee | 273/181 F |
| 4,171,812 | 10/1979 | Marsin | 273/185 R |
| 4,395,042 | 7/1983 | Boswell | 273/181 A |
| 4,492,380 | 1/1985 | Saytar | 273/181 F |

FOREIGN PATENT DOCUMENTS

| | | | |
|---|---|---|---|
| 13201 | of 1887 | United Kingdom | 273/400 |
| 21909 | of 1906 | United Kingdom | 273/181 F |
| 197804 | 4/1978 | United Kingdom | 273/181 F |

*Primary Examiner*—George J. Marlo
*Attorney, Agent, or Firm*—Basile & Hanlon

[57] ABSTRACT

A frame held in an operative position, and used to mount a resilient energy dissipating surface. The resilient energy dissipating surface having at least one aperture, defining a target area, in communication with a hollow resilient energy dissipating sleeve. A hollow resilient energy dissipating sleeve having two ends, the end opposite an aperture in the resilient energy dissipating surface being open and in communication with a golf ball retaining receptacle. In the alternative, or additionally depending on the number of apertures and corresponding sleeves present, an end opposite an aperture in the resilient energy dissipating surface may be closed for storage of golf balls within a sleeve after the golf balls have entered an aperture in the resilient energy dissipating surface. Furthermore, the frame can be constructed to be collapsible for easy transportation and storage.

3 Claims, 1 Drawing Sheet

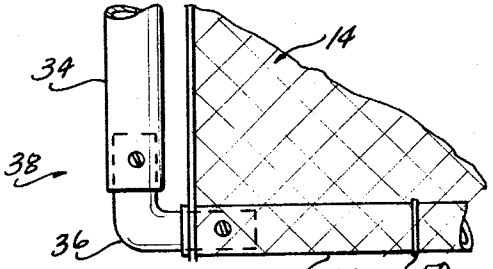
FIG-3
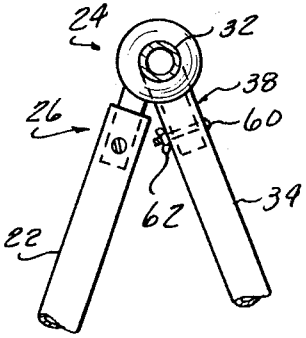
FIG-4
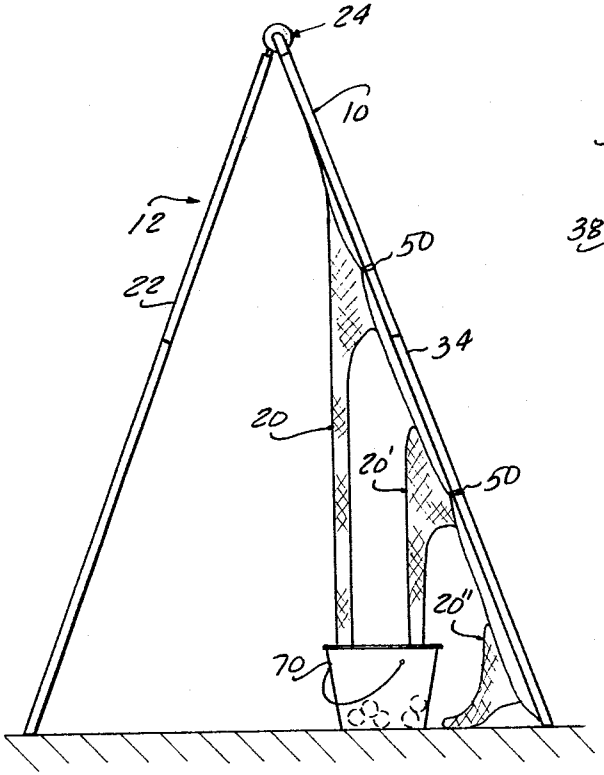
FIG-2
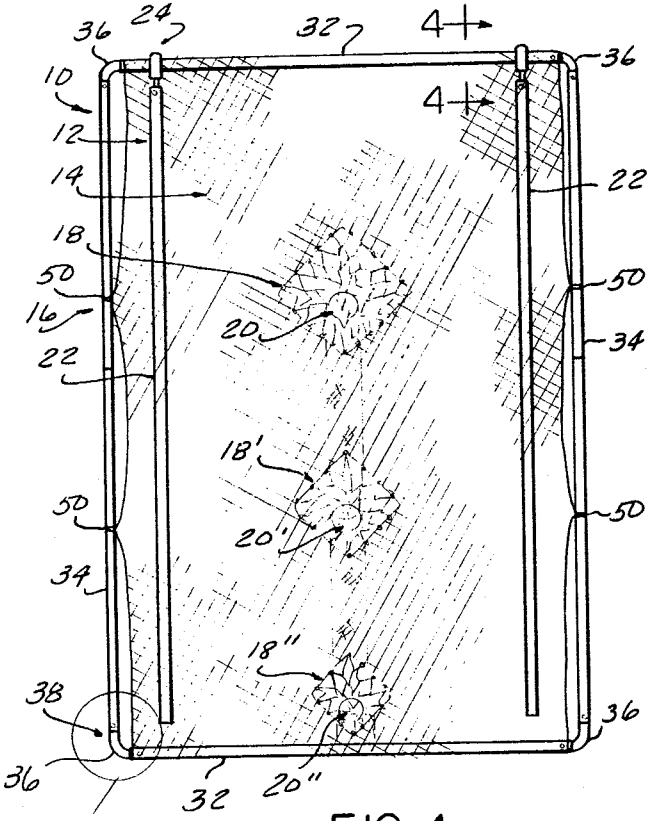
FIG-1
FIG-3

GOLF PRACTICE APPARATUS

BACKGROUND OF THE INVENTION

1. Field of the Invention

The present invention relates to a golf practice apparatus for use indoors or outdoors, allowing the individual to use various golf clubs by aiming at specific target areas. Balls which strike the target areas are retained in suitable receptacles, while those which miss the target areas will be deposited at the base of the golf practice apparatus or by adjusting the golf practice apparatus can be bounced back to the vicinity of the user.

2. Description of the Prior Art

The relevant prior art discloses many golf practice devices. The devices disclosed use of a plurality of independent upstanding target boards or target curtains, or hollow spherical targets having a plurality of target holes. Some of these prior art devices incorporate electrical lights for indication of the particular target board, curtain, or hollow spherical target, which was hit or entered by the golf ball. These devices because of their elaborate design and construction were bulky and expensive, therefore being difficult for the average golfer to purchase, transport, store or use.

It is therefore desirable that a golf practice apparatus be invented that combines a lightweight collapsible structure for easy storage and transportation with lower cost to provide the individual golfer with the opportunity to purchase and practice golf in his own home or yard.

SUMMARY OF THE INVENTION

A golf practice apparatus is disclosed comprising a rectangular frame, preferably having a pair of horizontal frame members, a pair of vertical frame members, a plurality of connecting members having two ends oriented approximately 90 degrees apart, means for securing the frame members together, means for supporting the rectangular frame in an operative position, preferably including a pair of support members with means for pivotally attaching the support members to one of the horizontal frame members, means for affixing the support members to the pivotal attaching means, a resilient energy dissipating surface, means for mounting the resilient energy dissipating surface within the frame, the resilient energy dissipating surface having an aperture, defining a target area, and a resilient energy dissipating sleeve in communication with the aperture and extending downwardly therefrom. The frame and support members are preferably made from a lightweight tubular material and fastened together using a screw and wing nut combination. The apertures can be of varying sizes and preferably are position centered on the vertical axis equidistant from the vertical frame members. The sleeve attaching to the aperture in the resilient energy dissipating surface can be either open on the opposite end to dispense golf balls into a suitable receptacle or the opposite end can be closed to provide a sleeve for storage of golf balls which enter through the aperture of the resilient energy dissipating surface.

BRIEF DESCRIPTION OF THE DRAWING

In the drawings like reference numerals refer to like elements in the various views shown in which:

FIG. 1 is a front view of the golf practice apparatus as seen by an individual using this invention;

FIG. 2 is a side view of the golf practice apparatus shown in FIG. 1, showing multiple sleeves, the open ended resilient energy dissipating sleeves leading to a suitable golf ball receptacle and another close ended resilient energy dissipating sleeve for temporary storage of golf balls;

FIG. 3 is an enlarged, detailed view of the corner joint showing a preferred embodiment of the collapsible rectangular frame; and FIG. 4 is an enlarged, detailed view of the pivotal attachment means for the support members to the rectangular frame.

DESCRIPTION OF THE PREFERRED EMBODIMENTS

Referring now to FIG. 1, the present invention comprises a frame 10. In a non-limiting preferred embodiment, the frame 10 is rectangular. The rectangular frame 10 is also preferably collapsible and comprises a pair of horizontal members 32, a pair of vertical members 34, and a plurality of connecting members 36. Furthermore, it is preferable that the frame be made of durable lightweight material, such as hollow metal or plastic tubing. In addition, the plurality of connecting members 36 can comprise hollow tubular elbows. The rectangular frame 10 described above is held together by means for releasably securing 38 the horizontal members 32 and vertical members 34 to the connecting members 36. The releasable securing means 38, in a preferred embodiment, can comprise a screw 60 passing through the horizontal member 32 or vertical member 34 and one of the plurality of connecting members 36. The elements being held in place by a wing nut 62 threadingly attached to the screw 60 as shown in FIGS. 3 and 4.

As shown in FIGS. 1 and 2, the vertical members 34 may be of a two part, separable construction for ease of disassembly into a small, compact form. The two sections of each vertical member 34 may interconnect in any conventional manner, such as forming a reduced diameter end portion on one of the sections which slidably and removably fits into the opposed section of the vertical member 34. Alternately the two sections can be telescoped together to selectively vary the length of the vertical members 34.

Referring again to FIG. 1, a resilient energy dissipating surface 14 is positioned within the rectangular frame 10. The resilient energy dissipating surface 14, in preferred embodiments, can comprise either a mesh surface or a fabric surface. The mesh surface comprising strands of material woven or intertwined to form a net-like surface having spacings between the strands less than the diameter of a standard golf ball. The fabric surface comprising natural or synthetic material, for example canvas, nylon or similar materials. Means for mounting 16 the resilient energy dissipating surface 14 within the rectangular frame 10 are also provided. By way of a non-limiting example, the mounting means 16 can comprise a resilient energy dissipating mesh surface 14 where the mesh is threaded over the horizontal members 32 and secured in place by elastic ties 50 positioned along the horizontal members 32 and vertical frame member 34. In addition, the resilient energy dissipating surface 14 has an aperture 18 defining a target area. Furthermore, the present invention is not limited to a single aperture 18, but may comprise a plurality of apertures in the energy dissipating surface 14. For the sake of simplicity, the following description will refer to a single aperture 18 with the understanding that it is equally applicable to each aperture in a plurality of apertures.

The aperture 18 in the resilient energy dissipating surface 14 is in communication with one end of a hollow resilient energy dissipating sleeve 20 having two ends. Referring now to FIG. 2, the resilient energy dissipating sleeve 20 extends downwardly from the aperture 18. The end of the hollow resilient energy dissipating sleeve 20 opposite the aperture 18 can be open and unobstructed to deposit golf balls entering the sleeve 20 into a suitable golf ball receptacle 70. In an alternative embodiment, the end may be closed to form an obstruction to the passage of golf balls thereby providing storage for golf balls within the hollow resilient energy dissipating sleeve 20 itself. The hollow resilient energy dissipating sleeve 20 may comprise a mesh sleeve or a fabric sleeve. In a preferred embodiment, the aperture 18 is centered on a vertical axis equidistant from the vertical members 34 of the rectangular frame 10. Furthermore, in the case of a plurality of apertures, the preferred embodiment would center each aperture 18 on the vertical axis equidistant from the vertical frame members 34 of the rectangular frame 10. Also in a plurality of apertures configuration, the apertures 18, 18', 18" may comprise various pre-determined sizes, shapes and diameters, in communication with hollow resilient energy dissipating sleeves 20 of various lengths with either open ends, such as sleeves 20 and 20', leading to a suitable golf ball receptacle 70 or closed ends, such as sleeve 20", or a combination of some sleeves having closed ends and some sleeves having open ends as shown in FIG. 2.

Referring now to FIGS. 1, 2 and 4, means for supporting 12 the rectangular frame 10 in an operative position are provided in the present invention. A preferred embodiment of supporting means comprises a pair of support members 22, means for pivotally attaching 24 the pair of support members 22 to the rectangular frame 10, and means for releasably affixing 26 the pair of support members 22 to the pivotal attaching means 24.

The support member 22 may be of a single piece construction, multiple sections similar to the vertical members 34, or multiple sections telescopingly engageable to vary the angle of the energy dissipating surface 14 with respect to the floor or ground.

In the preferred embodiment shown in FIG. 4, the pivotal attaching means 24 is positioned around the upper horizontal frame member 32. One of the pair of support members 22 is connected to the pivotal attaching means 24 by releasable affixing means 26. The releasable affixing means 26, in a preferred embodiment, can comprise a screw 60 passing through apertures in the pivotal attaching means 24 and one of the pair of support members 22 and is secured by a wing nut 62 threadingly engaged on the screw 60. As previously disclosed in regard to the rectangular frame member 10, it is preferred that the support members 22 be made of a lightweight and durable material, such as hollow tubing.

The golf practice apparatus of the present invention as described in the preferred embodiment above would be used in the following manner. An individual could set the apparatus up in a desirable location, either indoors or outdoors, and take a position in front of the resilient energy dissipating surface 14 at a suitable distance away. By aiming at the appropriate target area for the club of the individual's choice, the individual can determine the accuracy of his shot by observing whether the ball enters the target area and the hollow resilient energy dissipating sleeve 20 or strikes the resilient energy dissipating surface 14. Upon striking the golf ball, its trajectory should under normal circumstances carry it within the rectangular frame 10 thereby causing it to contact the resilient energy dissipating surface 14 or the hollow resilient energy dissipating sleeve 20. Upon striking this surface 14 or entering the sleeve 20, the energy of the golf ball's motion is dissipated from the point of contact through the remainder of the surface 14 or the sleeve 20. The energy being thus dissipated, a golf ball hitting the resilient energy dissipating surface 14 would normally fall harmlessly, due to gravitational forces, to the floor in front of the golf practice apparatus, or in the case of entering the sleeve 20 would travel through the hollow resilient energy dissipating sleeve 20 to be deposited in a suitable golf ball receptacle 70 or in the case of a sleeve 20 having one end closed the golf ball would come to rest within the lower portion of the hollow resilient energy dissipating sleeve 20.

It should be noted that the golf practice apparatus is intended to teach the user proper swing, feel and eye-hand movements used in chipping and pitching golf balls relatively short distances from around a golf green. It is not intended for use or longer drives.

In the multiple aperture shown in FIG. 1, the three apertures 18, 18' and 18" are spaced vertically apart a pre-determined distance in the energy dissipating surface 14. The relative position of each aperture 18, 18' and 18" enables the user to practice and learn the coordination to hit various types of golf clubs. By properly positioning himself at a pre-determined distance in front of the energy dissipating surface 14, the user of this golf practice apparatus by using the lofted clubs, such as a 9 iron, a pitching wedge or a sand wedge and aim for the uppermost aperture 18 and develop the proper skill to effectively hit a golf ball with these clubs to a desired position. Similarly, the intermediate aperture 18' may be used with medium range irons, such as 6, 7 or 8 irons which have a less lofted club head thereby providing less loft than the lofted clubs in a slightly longer distance. Finally, the lowermost aperture may be used with longer range irons, such as a 3, 4 or 5 iron in which the trajectory of the struck ball is substantially flat but provides a greater distance or roll for the ball.

As an alternative, the elastic ties 50 mounting the resilient energy dissipating surface 14 to the rectangular frame 10 can be tightened to the point where a golf ball striking the resilient energy dissipating surface 14 would rebound slightly and roll in the direction of the individual using the golf practice apparatus. After completing the desired number of practice shots, the individual can collect the golf balls deposited within the golf ball receptacle 70 and those deposited within the closed end sleeves 20, as well as those which have come to rest in front of the base of the rectangular frame 10. The golf practice apparatus can then be disassembled for easy compact storage or transportation to a new location.

I claim:

1. A golf practice apparatus comprising:

a single golf ball retaining receptacle;

a frame;

means for supporting the frame in an operative position;

a resilient, golf ball restraining, energy dissipating surface having a plurality of apertures, said plurality of apertures defining target areas having different size openings through said surface and each of said plurality of apertures aligned on a single vertical axis centered horizontally on said frame, said plurality of apertures disposed with a largest target area vertically uppermost progressing vertically downward to a smallest target area vertically lowermost;

a plurality of elastic ties for releasably mounting the resilient energy dissipating surface within the frame disposed in spaced relationship around the entire frame; and a plurality of elongated, resilient, hollow, golf ball restraining, energy dissipating sleeves having open ends, one end of a sleeve connected to and extending downwardly from a respective corresponding aperture in the surface and another end opening directly into said single golf ball retaining receptacle, wherein energy of a golf ball dissipates through the sleeve and surface, and any golf ball entering a hollow sleeve is deposited directly from the sleeve into the single golf ball retaining receptacle for retrieval.

2. The golf practice apparatus of claim 1, wherein the supporting means comprises:

a pair of support members; and means for pivotally attaching the pair of support members to the frame.

3. A golf practice apparatus comprising:

a single golf ball retaining receptacle;

a rectangular frame having a pair of horizontal tubular frame members, a pair of vertical tubular frame members, a plurality of tubular connecting members having two ends orientated approximately 90° apart, and means for releasably securing one of the pair of horizontal frame members and one of the pair of vertical frame members to each end of one of the plurality of connecting members, respectively;

a pair of tubular support members;

means for pivotally attaching the pair of support members to the rectangular frame;

means for releasably affixing the pair of support members to the pivotal attaching means;

a resilient, golf ball restraining, energy dissipating mesh surface having a plurality of apertures defining target areas equidistant from the pair of vertical frame members, the target areas having different sizes and aligned on a single vertical axis centered horizontally on the frame, the target areas disposed having a largest target area vertically uppermost and progressing downwardly by size to a smallest target area vertically lowermost;

a plurality of elastic ties spaced around a periphery of the rectangular frame for releasably mounting the resilient energy dissipating mesh surface within the rectangular frame; and a plurality of elongated, hollow, resilient, golf ball restraining, energy dissipating sleeves having open ends, one end of a sleeve connected to and extending downwardly from a respective corresponding aperture in the surface and another opening directly into said single golf ball retaining receptacle, wherein energy of a golf ball dissipates through the sleeve and surface, and any golf ball entering the hollow sleeve is deposited directly from the sleeve into the single golf ball retaining receptacle for retrieval.

* * * * *